US008970369B2

(12) United States Patent
Bird et al.

(10) Patent No.: US 8,970,369 B2
(45) Date of Patent: Mar. 3, 2015

(54) "INVISI WALL" ANTI-THEFT SYSTEM

(75) Inventors: Gregory M. Bird, Solon, OH (US); Shane Obitts, Elyria, OH (US); Scott Arthur McMullen, Toronto (CA)

(73) Assignee: Fasteners For Retail, Inc., Twinsburg, OH (US)

( * ) Notice: Subject to any disclaimer, the term of this patent is extended or adjusted under 35 U.S.C. 154(b) by 376 days.

(21) Appl. No.: 13/231,485

(22) Filed: Sep. 13, 2011

(65) Prior Publication Data

US 2012/0062380 A1 Mar. 15, 2012

Related U.S. Application Data

(60) Provisional application No. 61/382,122, filed on Sep. 13, 2010.

(51) Int. Cl.

| | |
|---|---|
| ***G08B 1/08*** | (2006.01) |
| ***G08B 13/184*** | (2006.01) |
| ***G08B 13/196*** | (2006.01) |
| *G08B 13/14* | (2006.01) |

(52) U.S. Cl.

CPC ..... *G08B 13/184* (2013.01); *G08B 13/19697* (2013.01); *G08B 13/1481* (2013.01)

USPC ..... 340/539.31; 340/5.61; 340/541; 340/539.1; 340/568.8

(58) Field of Classification Search

USPC ..... 340/539.31, 5.61, 541, 505, 539.1, 340/545.3, 565, 568.8

See application file for complete search history.

(56) References Cited

U.S. PATENT DOCUMENTS

| | | | | |
|---|---|---|---|---|
| 3,739,372 | A * | 6/1973 | Schlisser et al. | 340/556 |
| 5,229,749 | A | 7/1993 | Yenglin | |
| 5,392,025 | A | 2/1995 | Figh et al. | |
| 6,720,874 | B2 | 4/2004 | Fufido et al. | |
| 6,982,649 | B2 * | 1/2006 | Blum et al. | 340/815.4 |
| 7,019,648 | B2 * | 3/2006 | Gagnon | 340/552 |
| 7,095,008 | B2 * | 8/2006 | Klingelhoefer et al. | 250/221 |
| 7,200,246 | B2 * | 4/2007 | Cofer et al. | 382/103 |
| 7,411,497 | B2 * | 8/2008 | Kates | 340/556 |
| 7,451,881 | B2 | 11/2008 | Hardy et al. | |
| 7,466,224 | B2 * | 12/2008 | Ward et al. | 340/522 |
| 7,805,209 | B2 * | 9/2010 | Bechtel et al. | 700/79 |
| 7,845,948 | B2 * | 12/2010 | Barnes et al. | 434/219 |
| 7,852,257 | B2 * | 12/2010 | Wu et al. | 342/28 |
| 7,905,413 | B2 | 3/2011 | Knowles et al. | |
| 7,994,914 | B2 | 8/2011 | Irmscher et al. | |
| 8,018,334 | B1 * | 9/2011 | DiMartino et al. | 340/539.11 |
| 8,102,238 | B2 * | 1/2012 | Golander et al. | 340/5.2 |
| 8,354,928 | B2 * | 1/2013 | Morcom | 340/555 |
| 2002/0017604 | A1 * | 2/2002 | Nakazaki et al. | 250/221 |
| 2006/0040792 | A1 * | 2/2006 | Muneta | 482/8 |
| 2007/0294207 | A1 | 12/2007 | Brown et al. | |
| 2008/0297602 | A1 * | 12/2008 | Chang | 348/162 |
| 2011/0273293 | A1 * | 11/2011 | Itkin et al. | 340/557 |
| 2011/0298579 | A1 * | 12/2011 | Hardegger et al. | 340/3.1 |
| 2012/0038456 | A1 * | 2/2012 | Pikkarainen et al. | 340/5.61 |

* cited by examiner

*Primary Examiner* — Eric M Blount
(74) *Attorney, Agent, or Firm* — Fay Sharpe LLP

(57) ABSTRACT

A system which monitors a display of products includes a motion detection unit. The motion detection unit is configured to receive an electromagnetic signal from a sensor concerning a portion of a plane disposed between at least one product held in a display and an individual. Further, the motion detection unit determines whether the portion of the plane is breached based on temporal deviations in the electromagnetic signal and, in response to determining a breach, generates a notification of the breach.

18 Claims, 4 Drawing Sheets

10
12
12
12

"INVISI WALL" ANTI-THEFT SYSTEM

This application claims the benefit of U.S. Provisional Application No. 61/382,122, filed Sep. 13, 2010, which is incorporated herein by reference in its entirety.

BACKGROUND

The present exemplary embodiments relate generally to theft deterrence. They find particular application in conjunction with product displays at retail stores, and will be described with particular reference thereto. However, it is to be appreciated that the present exemplary embodiments are also amenable to other like applications.

Retail stores often include floor layouts in which products are arranged in product displays so as to form aisles. A product display serves to emphasize a product and/or a class of products within a retail store and includes any structure holding products, such as a shelf and/or freezer bin, and/or grouping of like products. Typically, products disposed in product displays are freely accessible to customers. Customers desiring to purchase a product simply pick up the product and bring it to a store clerk, where they then pay for the product.

One problem with allowing customers to freely access products in a typical floor layout is that store clerks often lack an unobstructed view of the product displays. As such, products disposed in the product displays are prone to damage and/or vandalism from mischievous customers. Even more, products are prone to theft. Due to the large expense this conduct imposes upon retailers, they have been searching for ways to prevent and/or deter theft.

Known solutions to this problem often involve locking products in product displays. However, this places an increased burden upon store clerks, since a customer must call them whenever the customer wishes to purchase a product. Further, requiring that a customer seek assistance from a store clerk can dissuade the customer from purchasing a product. It adds an element of inconvenience to the customer's shopping experience. Even more, it can be costly to retrofit existing product displays and/or to buy new theft deterrent product displays.

The present disclosure contemplates new and improved systems and/or methods for remedying these, and other, problems.

BRIEF DESCRIPTION

Various details of the present disclosure are hereinafter summarized to provide a basic understanding. This summary is not an extensive overview of the disclosure and is intended neither to identify certain elements of the disclosure, nor to delineate the scope thereof. Rather, the primary purpose of the summary is to present certain concepts of the disclosure in a simplified form prior to the more detailed description that is presented hereinafter.

According to one aspect of the present disclosure, a system for monitoring a display of products is provided. The system includes a motion detection unit. The motion detection unit is configured to receive an electromagnetic signal from a sensor concerning a portion of a plane disposed between at least one associated product held in an associated display and an associated individual. Further, the motion detection unit determines whether the portion of the plane is breached based on temporal deviations in the electromagnetic signal and, in response to determining a breach, generates a notification of the breach.

According to another aspect of the present disclosure, a method for monitoring a display of products is provided. The method includes providing a sensor and receiving an electromagnetic signal from the sensor concerning a portion of a plane disposed between at least one product in a display and an individual. A determination is made as to whether the portion of the plane is breached based on temporal deviations in the electromagnetic signal. In response to determining a breach, a notification of the breach is generated.

BRIEF DESCRIPTION OF THE DRAWINGS

The following description and drawings set forth certain illustrative implementations of the disclosure in detail, which are indicative of several exemplary ways in which the various principles of the disclosure may be carried out. The illustrative examples, however, are not exhaustive of the many possible embodiments of the disclosure. Other objects, advantages and novel features of the disclosure will be set forth in the following detailed description of the disclosure when considered in conjunction with the drawings, in which.

DETAILED DESCRIPTION

Figure 1:
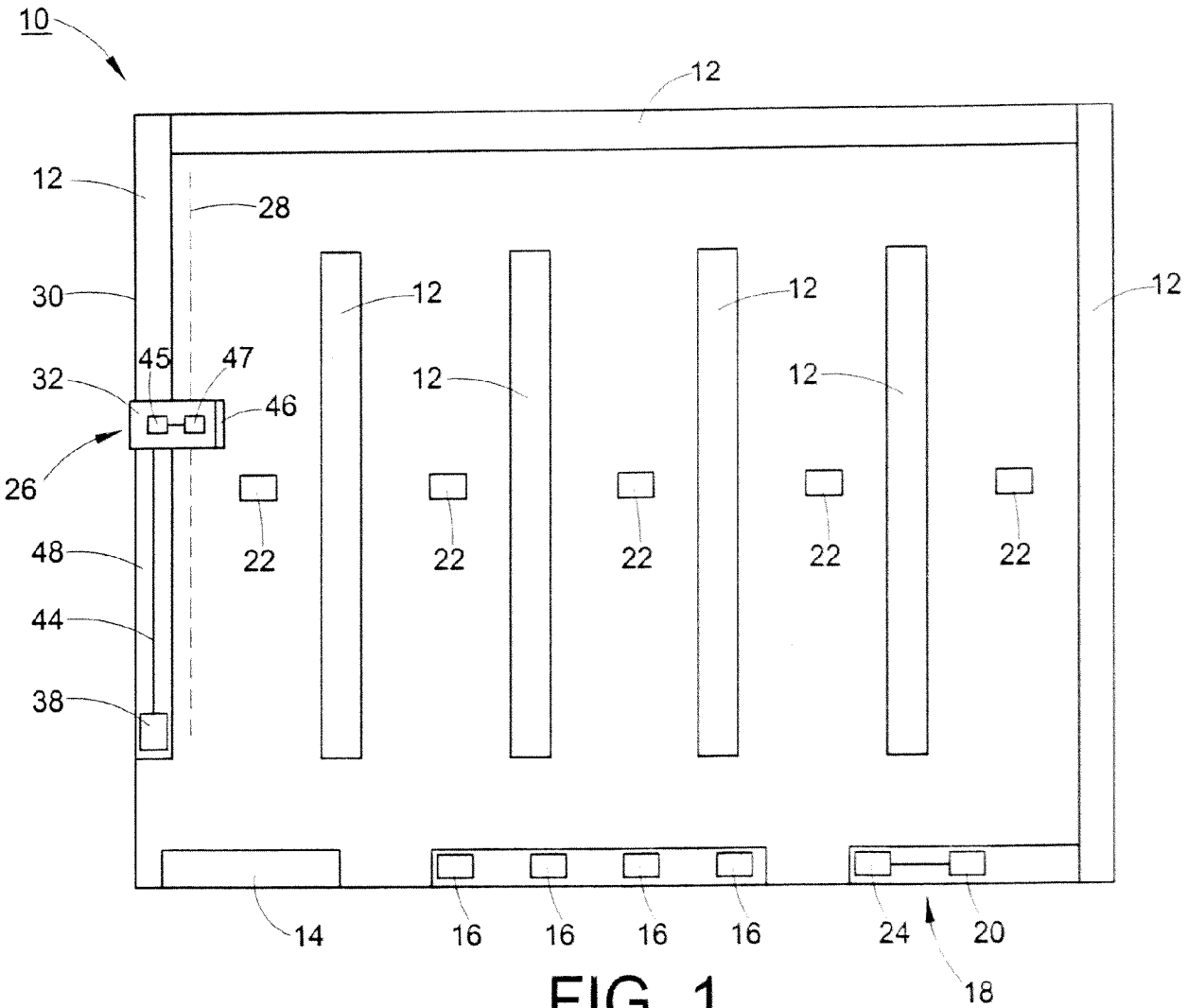
FIG. 1 is a schematic top plan view of a retail store having a product display monitoring system according to one embodiment of the present disclosure.

One or more embodiments or implementations are hereinafter described in conjunction with the drawings, where like reference numerals are used to refer to like elements throughout, and where the various features are not necessarily drawn to scale.

With reference to FIG. 1, a schematic top plan view of a retail store 10 is illustrated. The retail store 10 is suitably one of a drug store, a grocery store, a hardware store, a jewelry store, and the like. However, other types of stores are also contemplated. The retail store 10 includes one or more product displays 12. The product displays 12 carry products for sale and typically define aisles within the retail store 10. The products may include, for example, makeup, over the counter pharmaceuticals, groceries, tools, and the like. The product displays 12 may be disposed along walls of the retail store 10 and/or offset from walls of the retail store 10. Further, the product displays 12 typically include one or more vertically spaced shelves, optionally covered by a protective case. However, in some embodiments, the product displays 12 include bins, mere groupings of products, and the like.

An entrance 14, such as a door, of the retail store 10 allows customers of the retail store 10 to enter and/or exit the retail store 10. The entrance 14 is suitably located next to one or more checkout registers 16 of the retail store 10, so that store clerks manning the checkout registers 16 can view the ingress and egress of customers. The checkout registers 16 provide customers wishing to purchase products with a location to pay for the products. While store clerks suitably man the checkout registers 16, the checkout registers 16 may additionally, or alternatively, allow for self-checkout. In some embodiments, the entrance 14 may be associated with RFID scanners and/or other like security measures so as to deter and/or reduce theft. Further, although only a single entrance is shown, additional entrances are contemplated.

An optional surveillance system 18 may include a controller 20, one or more security cameras 22, and an optional display monitor 24. The controller 20 monitors video streams from the cameras 22 and, in some embodiments, displays one or more video streams from the cameras 22 on the display monitor 24. In displaying video streams on the display monitor 24, the controller 20 may, for example, change the video streams displayed on the display monitor 24 at periodic intervals and/or change the video streams displayed on the display monitor 24 to video streams of cameras capturing motion. The controller 20 further, in some embodiments, records and/or archives video streams from the cameras 22 to a memory or database. The cameras 22 may include, but are not limited to, one or more of black and white cameras, infrared cameras, night vision cameras, cameras having rotating and/or zooming capabilities, and the like. The display monitor 24 is suitably located within the view of one or more store clerks and/or one or more security guards.

A product display monitoring system 26 generates an invisible wall 28, occupying a portion of a generally vertically oriented plane, which is disposed between customers and the products held or disposed in a product display 30. Additional product display monitoring systems may be employed for other product displays. When a customer breaches the invisible wall 28, the product display monitoring system 26 typically notifies security guards and/or store clerks thereof. However, other actions, some of which are described below, are also contemplated. A breach includes, for example, a customer crossing the invisible wall 28 with an appendage.

As mentioned, the invisible wall 28 can be and typically is oriented vertically. However, in some embodiments, the invisible wall 28 is oriented horizontally or at an angle from a horizontal or vertical axis. Further, two co-planar, perpendicular axes typically define the plane of the invisible wall 28. The invisible wall 28 extends predetermined distances from the product display monitoring system 26 along the two axes, in one or both directions of each of the two axes. For example, when the invisible wall 28 is arranged substantially vertically (e.g., less than 20 degrees from the vertical axis), the invisible wall 28 extends along the first axis between the top of the product display 30 and the bottom of the product display 30 and along the second axis across the width of the product display 30. The predetermined distances are set by the size of the product display 30 and bounded by the specific design of the product display monitoring system 26. For example, in one embodiment, the invisible wall can selectively extend up to 45 feet from the product display monitoring system 26 in each direction of each axis.

If the product display 30 extends beyond the range of a single product display monitoring system 26 or includes a bend, one or more additional product display monitoring systems may be employed to monitor the product display. The additional product display monitoring systems and the product display monitoring system 26 may be interconnected or operated independently. As to the former, for example, one of the product display monitoring systems may be configured as a master system and the other product display monitoring systems may be configured as slave systems, whereby the master system acts in response to a breach of an invisible wall of any of the other product display monitoring systems. Such an arrangement can additionally be employed with additional display monitoring systems for other product displays. Communication between the product display monitoring systems may be carried out using one or more of a cable, wireless link, a communications network, and so on.

A motion detection unit 32 of the product display monitoring system 26 generates the invisible wall 28, detects a breach thereof, and optionally determines the location of the breach. The motion detection unit 32 suitably generates the invisible wall 28 actively or passively using electromagnetic waves. In some embodiments, electromagnetic waves are transmitted over the full extent of the invisible wall 28 with an electromagnetic generator 34 (see FIGS. 3 and 4) and reflections of the electromagnetic waves are sensed with one or more sensors 36 (see FIGS. 3 and 4). Temporal deviations in the electromagnetic waves are then detected using, for example, reflection time, phase shift, frequency shift, and so on. These deviations are used as indicators of a breach. In other embodiments, electromagnetic waves given off by a person, such as infrared light, are sensed with the sensors 36 and used to detect a breach of the invisible wall 28. To avoid false alarms, further conditions may be required for detection of a breach. For example, the extent of a potential breach must exceed a predetermined amount. As another example, a potential breach must last a predetermined amount of time.

In some embodiments, the electromagnetic waves are generated using infrared light. In such embodiments, the electromagnetic generator 34 generates an infrared beam continuously scanning along the invisible wall 28. Further, the sensors 36 suitably monitor a reflection time of the infrared beam for variations. If the amount of time it took for the infrared beam to reflect back to the sensors 36 was x seconds during a first pass and the amount of time it took for the infrared beam to reflect back to the sensors 36 was y second during a second pass, then the invisible wall 28 is breached.

To determine the location of a breach, in some embodiments, the electromagnetic generator 34 scans back and forth across the invisible wall 28. When a breach is detected, the location can be determined based on the location of the electromagnetic generator in its scan path and the reflection time. In other embodiments, the sensors 36 can include a plurality of sensors disposed at different locations, each measuring one or more of reflection time, magnitude of the reflected electromagnetic waves, and so on. Trigonometry and/or multi-lateration, for example, can then be employed to determine location. Other approaches to determining location are contemplated and equally amenable.

When a breach is detected, the motion detection unit 32 typically generates an audio and/or visual warning for a security guard and/or a store clerk using a notification unit 38. An audio warning may be provided by way of a speaker or other audio source of the notification unit 38. Further, a visual warning may be provided by way of one or more light sources 40 (see FIGS. 3-4) of the notification unit 38. The light sources 40 may be of any color, such as blue. Further, the light sources 40 may shine steadily or blink at varying intervals and/or in varying patterns, remain activated for a predetermined period of time (e.g., five seconds), and the like, when a breach of the invisible wall 28 is detected.

Figure 2:
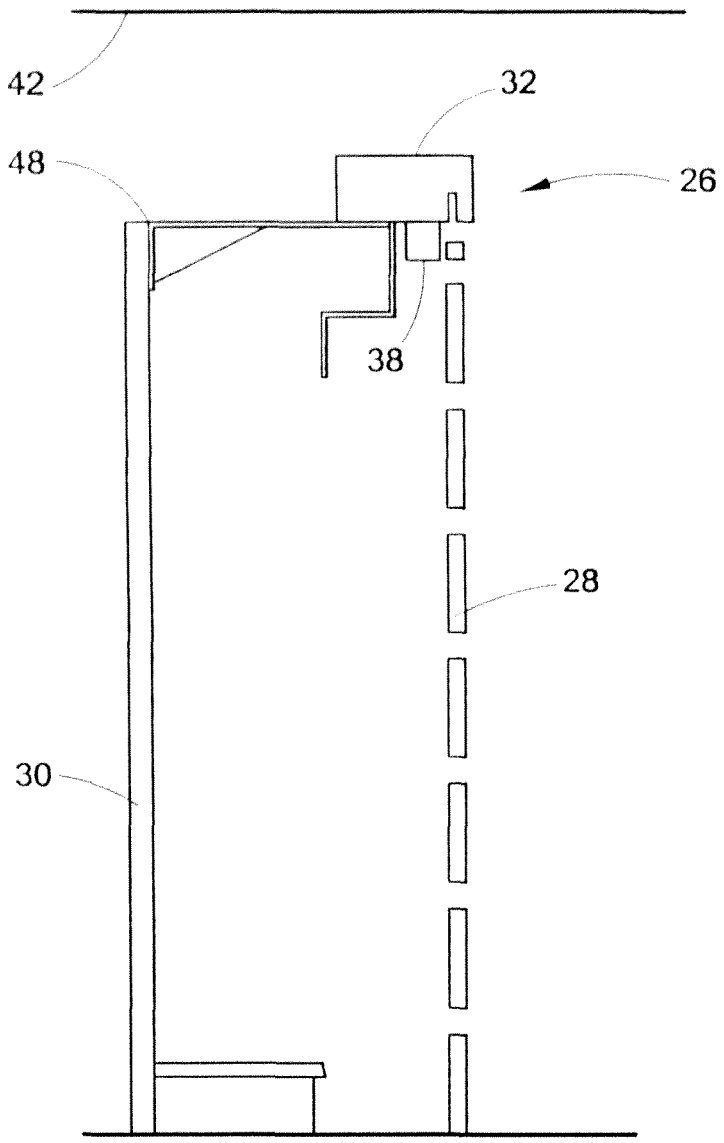
FIG. 2 is a schematic end elevational view of a product display having a product display monitoring system according to the present disclosure.
Figure 3:
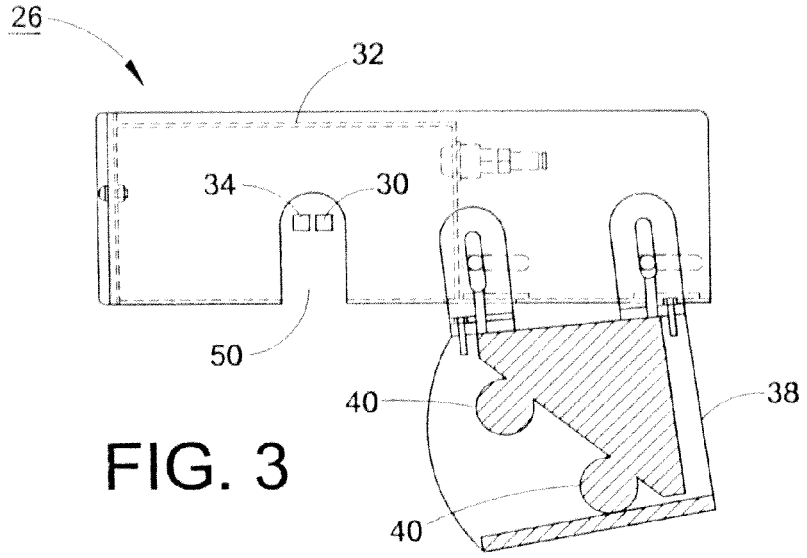
FIG. 3 is a schematic side elevational view of a product display monitoring system according to one embodiment of the present disclosure mounted to a header of a product display.
Figure 4:
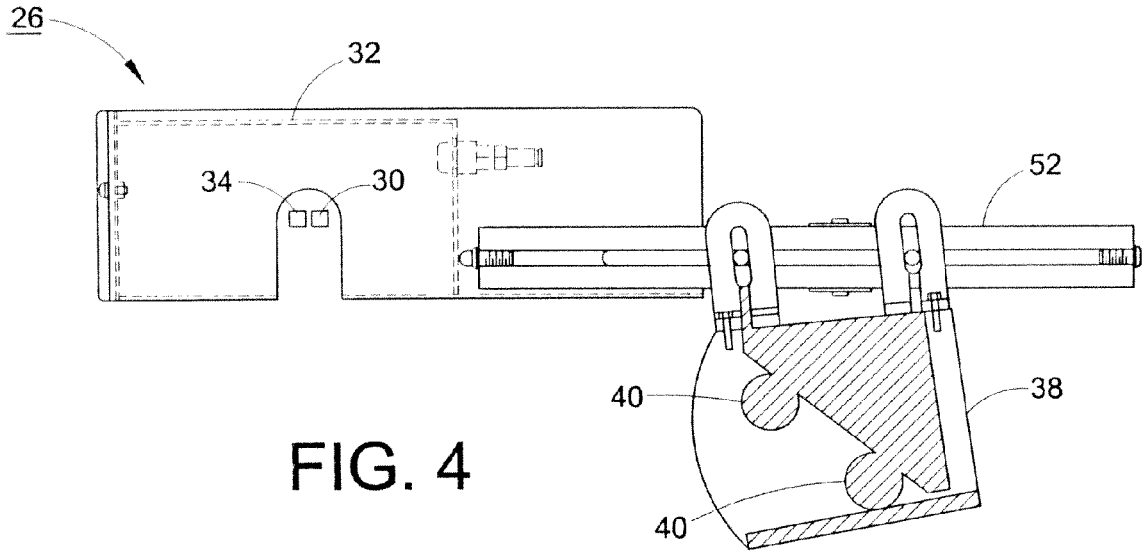
FIG. 4 is a schematic side elevational of a product display monitoring system according to another embodiment of the present disclosure mounted to a header of a product display; and, FIG. 5 is a flow chart of one embodiment of a method for monitoring a product display.

The notification unit 38 is suitably placed remote from the motion detection unit 32, as illustrated in FIG. 1. However, it may be mounted proximate to and/or on the motion detection unit 32, as illustrated in FIGS. 2-4. Further, the notification unit 38 is suitably mounted within the view of security guards and/or store clerks, typically on the ceiling 42 (see FIG. 2) of the retail store 10. The notification unit 38 receives control and/or trigger signals from the motion detection unit 32 from one or more of a cable 44, wireless link, a communications network, and the like.

Additionally or alternatively, in some embodiments, when a breach is detected, the motion detection unit 32 controls the surveillance system 18 to focus on the product display 30 with one of the cameras 22. In interfacing with the surveillance system 18, the motion detection unit 32 may instruct the surveillance system 32 to change the display monitor 24 of the surveillance system 18 to display a video stream of a security camera having a view of the invisible wall 28. As should be appreciated, this may have the effect of providing store clerks and/or security guards a visual notification of a breach. The motion detection unit 32 may also instruct the surveillance system 18 to record the video stream from a camera having a view of the invisible wall 28.

Additionally or alternatively, in some embodiments, when a breach is detected, the motion detection unit 32 stores a record of the breach, optionally including the location thereof, in a memory 45. Such data has value for purposes of marketing. For example, the data can be used to determine which products are most viewed, sought after, removed, and so on; where the most sought after products are located in the product display 30; which products have the most breaches; and so on. As another example, if the invisible wall 28 protects a certain product and has numerous breaches, but few purchases, it can be inferred that customers are interested in the product, but not at the current price. Other uses of this data will be apparent to those with marketing backgrounds.

The motion detection unit 32 may include a number of operating settings controlling operation of the motion detection unit 32. The operating settings may include, for example, one or more of what action to take in response to detecting a breach, parameters affecting particular actions, such as a strobe interval for a visual alert, sensitivity, the extent of the invisible wall 28 in each direction of the two axes, the minimum duration of a breach needed before providing notice, whether to interface with the surveillance system 18, and the like. Advantageously, the operating settings allow the motion detection unit 32 to account for floor displays and/or promotional advertising hanging off the product display 30 and/or planogram changes.

To set the operating settings, the motion detection unit 32 may include one or more user input devices 46, optionally covered with a protective cover. The user input devices 46 may include at least one of one or more dials, one or more buttons, one or more switches, a network interface, a wireless interface, and the like. The network interface may allow one to set the operating settings via a communications network, such as the Internet, a local area network, a wireless network, a telephone network, and the like, using, for example, a computer, a phone, and the like. The wireless interface may allow one to set the operating settings via a wireless link, such as a radio link, using, for example, a wireless remote control.

Typically, the motion detection unit 32 is placed centrally along at least one axis of the invisible wall 28. For example, when the invisible wall 28 is in a vertical or substantially vertical orientation, the product display monitoring system 26 is mounted centrally along the length of the product display 30. Advantageously, this allows the motion detection unit 32 to scan 180 degrees along the invisible wall 28. The extent of the invisible wall 28 is then adjusted to cover as many products in the product display 30 as possible. Typically, the motion detection unit 32 is mounted to the top or header 48 of the product display 30 or to the ceiling 42 of the retail store 10 adjacent the product display 30. However, other mount points are also contemplated.

The motion detection unit 32 may be embodied in hardware, software, or a combination thereof. In the exemplary embodiment, the motion detection unit 32 includes the memory 45 and a processor 47 in communication therewith. The memory 45 stores instructions for carrying out the above noted functions and which are executed by the processor 47. The memory 45 includes one or more of a non-transient computer readable medium; a magnetic disk or other magnetic storage medium; an optical disk or other optical storage medium; a random access memory (RAM), read-only memory (ROM), or other electronic memory device or chip or set of operatively interconnected chips; an Internet/Intranet server from which data may be retrieved or stored via the Internet/Intranet or a local area network; and the like. The processor 47 includes one or more of a microprocessor, a microcontroller, a graphic processing unit (GPU), an application-specific integrated circuit (ASIC), a field-programmable gate array (FPGA), and the like With reference again to FIG. 2, a schematic end elevational view of one embodiment of the product display 30 is illustrated. The product display monitoring system 32 establishes the invisible wall 28 in front of the product display 30 and monitors the invisible wall 28 for breaches using the motion detection unit 32. As illustrated, the invisible wall 28 has a vertical orientation. When a breach of the invisible wall 28 occurs, the motion detection unit 32 notifies a security guard and/or a store clerk using the notification unit 38, which is mounted to the motion detection unit 32. The notification unit 38 generates an audio and/or visual warning.

With reference to FIG. 3, a schematic side elevational view of one embodiment of the product display monitoring system 26 is provided. In this embodiment, the motion detection unit 32 includes a recessed area 50 housing components to generate the invisible wall 28. Suitably, said components include the electromagnetic generator 34 and the sensors 36. The electromagnetic generator 34 may, for example, include one or more infrared LEDs, and the sensors 36 may, for example, include one or more photodiodes. The notification unit 38 can be mounted directly to the motion detection unit 32 and can include the light sources 40 for generating a visual alert.

With reference to FIG. 4, a schematic side elevational view of another embodiment of the product display monitoring system 26 is provided. In contrast with the embodiment of FIG. 3, this embodiment includes a long configuration allowing the notification unit 38 to be distanced from the monitoring system 26 along a track 52 extending from the motion detection unit 32.

Figure 5:
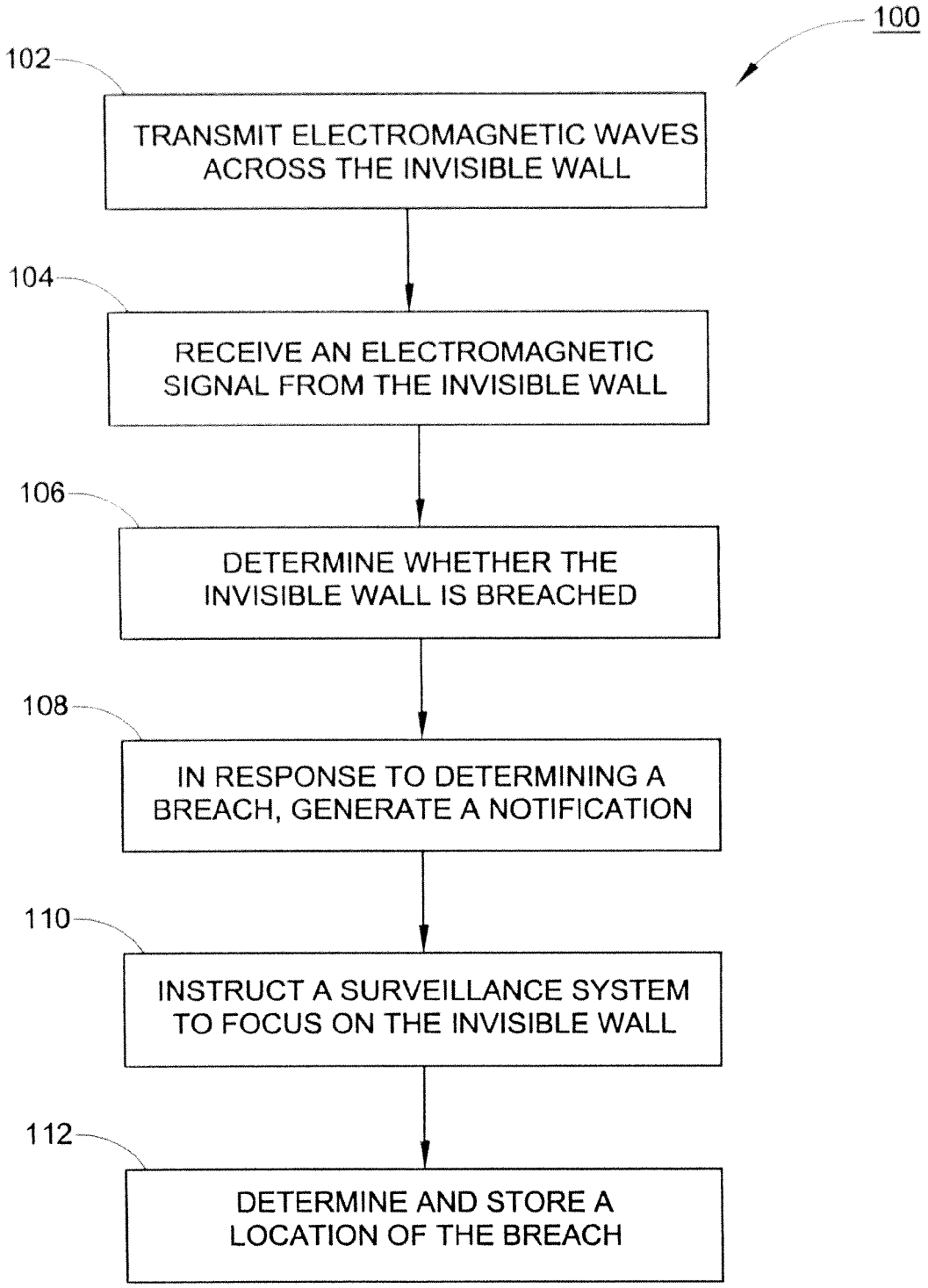

With reference to FIG. 5, a method 100 for monitoring the product display 30 is illustrated. Suitably, the motion detection unit 32 carries out the method 100. The method 100 optionally includes transmitting electromagnetic waves, as at 102, across the invisible wall 28 (i.e., a portion of a plane) using the beam generator 34. For example, a beam of infrared light may continuously scan across the invisible wall 28. Notably, this is an active method of generating the invisible wall 28. Passive methods which do not require actively transmitting electromagnetic waves across the invisible wall 28 are also contemplated.

An electromagnetic signal is received as at 104 from the invisible wall 28 using the sensors 36 and, based on temporal deviations in the received signal, a determination is made, as at 106, as to whether the invisible wall 28 is breached. Suitably this is carried out by measuring the amount of time it takes for the electromagnetic waves to reflect back. When the amount of time for the transmitted electromagnetic waves to reflect back varies temporally, a breach of the invisible wall is detected. For example, when an object is disposed within the invisible wall, the reflection time will likely be less than if the object was not there since the reflection time is usually the time to a floor of the store 10 and back.

In response to determining a breach, a notification thereof is typically generated, as at 108. This suitably entails notifying a security guard and/or a store clerk. Notice may, for example, by way of audio and/or visual indications. In some embodiments, the surveillance system 18 is additionally or alternatively instructed, as at 110, to focus a camera on the display when the portion of the plane is breached. The surveillance system 18 may then record the video stream and/or display the video stream on the display monitor 24 within the view of a security guard and/or a store clerk. In some embodiments, the location of the breach is additionally or alternatively determined and stored in the memory, as at 112. The data may also be used for marketing purposes.

The disclosure has been made with reference to preferred embodiments. Obviously, modifications and alterations will occur to others upon reading and understanding the preceding detailed description. For example, although the invisible wall is described in conjunction with a product display, it is equally amenable to other display types and other situations in which an invisible wall is needed. It is intended that the preferred embodiments be construed as including all such modifications and alterations insofar as they come within the scope of the appended claims or the equivalents thereof.

The invention claimed is:

1. A system for monitoring a display of products, said system comprising:

a product display monitoring system configured to generate an invisible wall occupying a portion of a generally vertically oriented plane disposed between at least one associated product held in an associated display and an associated individual; and a motion detection unit configured to:

receive an electromagnetic signal from a sensor concerning the portion of the plane disposed between at least one associated product held in an associated display and an associated individual;

determine whether the portion of the plane is breached based on temporal deviations in the electromagnetic signal; and, in response to determining a breach, generate a notification of the breach;

wherein the determination includes determining whether an object moves through the portion of the plane from one side of the plane to the other side of the plane.

2. The system according to claim 1, further including:

a notification unit which generates an audio or visual notification, wherein the notification unit is in communication with the motion detection unit.

3. The system according to claim 2, wherein said notification unit provides an audio and/or visual indication when the portion of the plane is breached.

4. The system according to claim 1, wherein the portion of the plane is breached when a limb of the associated individual reaches towards the associated display.

5. A system for monitoring a display of products, said system comprising:

a motion detection unit configured to:

receive an electromagnetic signal from a sensor concerning a portion of a plane disposed between at least one associated product held in an associated display and an associated individual;

determine whether the portion of the plane is breached based on temporal deviations in the electromagnetic signal; and in response to determining a breach, generate a notification of the breach;

wherein the motion detection unit includes:

a beam generator which generates an electromagnetic beam continuously scanning across the portion of the plane, wherein the electromagnetic signal includes a reflection of the beam; and wherein the portion of the plane is breached when a difference between reflection times of two consecutives scans exceeds a predetermined threshold.

6. The system according to claim 1, wherein the motion detection unit is mounted to the associated display or an adjacent portion of an associated ceiling.

7. The system according to claim 1, wherein said motion detection system instructs a surveillance system to focus a camera on the associated display when the portion of the plane is breached.

8. The system according to claim 1, wherein the motion detection unit determines a location of a breach on the portion of the plane.

9. The system according to claim 7, wherein the location is determined based on reflection times of electromagnetic waves transmitted across the portion of the plane.

10. A method for monitoring a display of products, said method comprising:

providing a sensor and receiving an electromagnetic signal from the sensor concerning a portion of a plane disposed between at least one product held in a display and an individual;

determining whether the portion of the plane is breached based on temporal deviations in the electromagnetic signal; and in response to determining a breach, generating a notification of the breach;

wherein the portion of the plane is breached when a limb of the individual reaches towards the display;

wherein the determining includes determining whether the limb moves through the portion of the plane from one side of the plane to the other side of the plane; and generating an electromagnetic beam continuously scanning across the portion of the plane, wherein the electromagnetic signal includes a reflection of the beam, wherein the portion of the plane is breached when a difference between reflection times of two consecutives scans exceeds a predetermined threshold.

11. The method according to claim 9, further including:

instructing a surveillance system to focus a camera on the display when the portion of the plane is breached.

12. The method according to claim 9, further including:

determining a location of the breach on the portion of the plane; and, storing the location of the breach in a memory.

13. The method according to claim 11, wherein the location is determined based on reflection times of electromagnetic waves transmitted across the portion of the plane.

14. A system for monitoring a display of products, said system comprising:

a product display monitoring system configured to generate an invisible wall occupying a portion of a generally vertically oriented plane disposed between at least one associated product held in an associated display and an associated individual; and a motion detection unit configured to:

receive an electromagnetic signal from a sensor concerning the portion of the plane disposed between at least one associated product held in an associated display and an associated individual;

determine whether the portion of the plane is breached based on temporal deviations in the electromagnetic signal; and, in response to determining a breach, generate a notification of the breach;

wherein the location and the size of the portion of the plane are defined by an operator of the motion detection unit before use of the motion detection unit.

15. The system of claim 1, wherein the portion of the plane is breached when an object localized to a single side of the plane transitions to extending through the portion of the plane from one side of the plane to the other side of the plane.

16. The system of claim 1, wherein the motion detection unit generates notifications or alarms only in response to a breach of a monitored portion of a plane.

17. The system according to claim 4, wherein the motion detection unit is mounted to the associated display or an adjacent portion of an associated ceiling.

18. The system according to claim 13, wherein the portion of the plane is breached when a limb of the associated individual reaches towards the associated display.

* * * * *